US008020679B2

(12) United States Patent
Wu

(10) Patent No.: US 8,020,679 B2
(45) Date of Patent: Sep. 20, 2011

(54) ROTATABLE FOOT-WHEEL USED FOR LUGGAGE TRUNK

(76) Inventor: Chen-Chuan Wu, Hsin Chuang (TW)

( * ) Notice: Subject to any disclaimer, the term of this patent is extended or adjusted under 35 U.S.C. 154(b) by 374 days.

(21) Appl. No.: 12/404,635

(22) Filed: Mar. 16, 2009

(65) Prior Publication Data

US 2010/0230223 A1 Sep. 16, 2010

(51) Int. Cl.
*B60B 33/00* (2006.01)

(52) U.S. Cl. ..... 190/18 A; 16/18 R; 16/21; 16/29; 16/43; 16/30; 16/18 CG

(58) Field of Classification Search ..... 16/18 R, 16/19, 20, 21, 22, 27, 29, 30, 43, 44; 190/18 A
See application file for complete search history.

(56) References Cited

U.S. PATENT DOCUMENTS 1,203,879 A * 11/1916 Janzen ..... 16/21
2,172,387 A * 9/1939 Kantrowitz ..... 16/21
4,777,697 A * 10/1988 Berndt ..... 16/21
5,594,974 A * 1/1997 Wattron et al. ..... 16/30
6,047,439 A * 4/2000 Stearn ..... 16/30
6,134,748 A * 10/2000 Kuo ..... 16/35 R
6,212,733 B1 * 4/2001 Yeh ..... 16/35 R
6,588,059 B1 * 7/2003 McCord ..... 16/30
7,681,702 B2 * 3/2010 Miyoshi ..... 190/18 A
2006/0059656 A1 * 3/2006 Hackett ..... 16/20

* cited by examiner

*Primary Examiner* — Tri Mai
(74) *Attorney, Agent, or Firm* — Ming Chow; Sinorica, LLC

(57) ABSTRACT

Disclosed is a rotatable foot-wheel used for a luggage trunk, that is provided to a user with a simple & convenient mounting and detaching means, such that in detaching a foot-wheel from a luggage trunk, upon securing a lower half portion element, all the user has to do is to move the step-shaped housing of an upper half portion element outward, so that balls on a ball portion are separated from the step-shaped housing, then rotating the foot-wheel to make it separate, thus achieving the purpose of detaching a rotatable foot-wheel, such that a user may replace worn-out elements by himself. When installing a new element or reinstalling a repaired element, similarly, upon securing a lower half portion element, moving step-shaped housing of an upper half portion element outward, so that balls on the ball portion rejoin with the step-shaped housing, hereby achieving the objective of fixing and re-installing foot-wheels.

4 Claims, 5 Drawing Sheets

ROTATABLE FOOT-WHEEL USED FOR LUGGAGE TRUNK

BACKGROUND OF THE INVENTION

1. Field of the Invention

The present invention relates to a rotatable foot-wheel used for a luggage trunk, and in particular to a rotatable foot-wheel that can be mounted and detached in a swift manner.

2. The Prior Arts

Nowadays, the bottoms of most of the luggage trunks are provided with wheel stands, so that luggage trunk does not need too much force to pull along, thus it is convenient to travel and tag along the road. However, after long period of usage by users, and due to long term wearing-out by friction between a wheel body of a rotatable foot-wheel of a luggage trunk and the ground, thus causing the wearing-out of wheel body, and resulting in the inconvenience of user while pulling a luggage truck along the road.

In the prior art, a rotatable foot-wheel is connected directly to a main body of a luggage trunk, so that when user would like to replace a worn-out wheel body, he has to go to a professional repairman or a vendor shop providing after-sales-service for replacement. In addition, a user must line up and then wait for the replacement of wheel body, and the replacement of wheel body itself will take quite some time. As such, a user having a worn-out wheel body must make a specific appointment with a repairman or a vendor shop for the repairment as required. Therefore, for the user of a luggage trunk having worn-out wheel body, the repairment and/or replacement of wheel body will take quite a lot of time.

In view of the problems and shortcomings of the prior art, the present invention provides a rotatable foot-wheel used for luggage trunk, so as to solve the afore-mentioned problems of the prior art.

SUMMARY OF THE INVENTION

A major objective of the present invention is to provide a rotatable foot-wheel of a luggage trunk, so that user is able to replace the worn-out elements by himself. The present invention provides a simple and easy detachment and mounting means for facilitating user in repairing and reusing luggage trunk in a swift manner.

The present invention provides a rotatable foot-wheel of a luggage trunk, including a wheel stand, the wheel stand includes a reception portion, and is provided with a blocking portion therein. A first connection portion is formed between a wheel stand and a blocking portion, and at least a wheel body is connected with a reception portion. When wheel body and wheel stand is connected together and the wheel body is subject to a force, then the wheel body will rotate freely relative to the wheel stand. Moreover, a rivet is used to pass through a ball bearing and an axle sleeve. A circular rotation block is provided with a hollow portion, and the hollow portion, axle sleeve, and ball bearing are connected in a sliding manner. A ball portion is provided on a ring-shaped surface of a circular rotation block, and a plurality of balls are disposed on a ball portion. The ball and an inner surface of a step-shaped housing is in rolling contact with each other, and the step-shaped housing can move freely in a first connection portion. A cover body is on its upper surface provided with a third connection portion and a rotation center hole. The third connection portion is used to connect to the luggage trunk. Upon joining together of a rivet, an axle sleeve, and a ball bearing, the rivet is used to pass through the hollow portion, the rotation central hole, and the inner ring diameter of the ring-shaped washer. The ring-shaped washer is used to connect and join together the rivet and the cover body.

Based on the structure mentioned above, such that in detaching a rotatable foot-wheel from a luggage trunk, upon securing a lower half portion element, all the user has to do is to move the step-shaped housing of an upper half portion element outward, so that balls on a ball portion are separated from the step-shaped housing, and then rotating the foot-wheel to make it separate, thus achieving the purpose of detaching a rotatable foot-wheel, such that a user may replace worn-out elements by himself. Likewise, when installing a new element or reinstalling a repaired element, for example, installing a new foot-wheel or reinstalling a repaired foot-wheel on a luggage trunk, in a similar manner, upon securing a lower half portion element, all the user has to do is to move the step-shaped housing of an upper half portion elements outward, so that balls on the ball portion rejoin with the step-shaped housing, hereby achieving the objective of fixing and re-installing. Meanwhile, a user may recombine easily a new element (for example, a new lower half portion element) with an upper half portion element of a rotatable foot-wheel, thus obtaining an almost brand new rotatable foot-wheel. Therefore, a user may replace a worn-out element all by himself, and thus a user may re-use a repaired luggage trunk in a speed manner.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Figure 1:
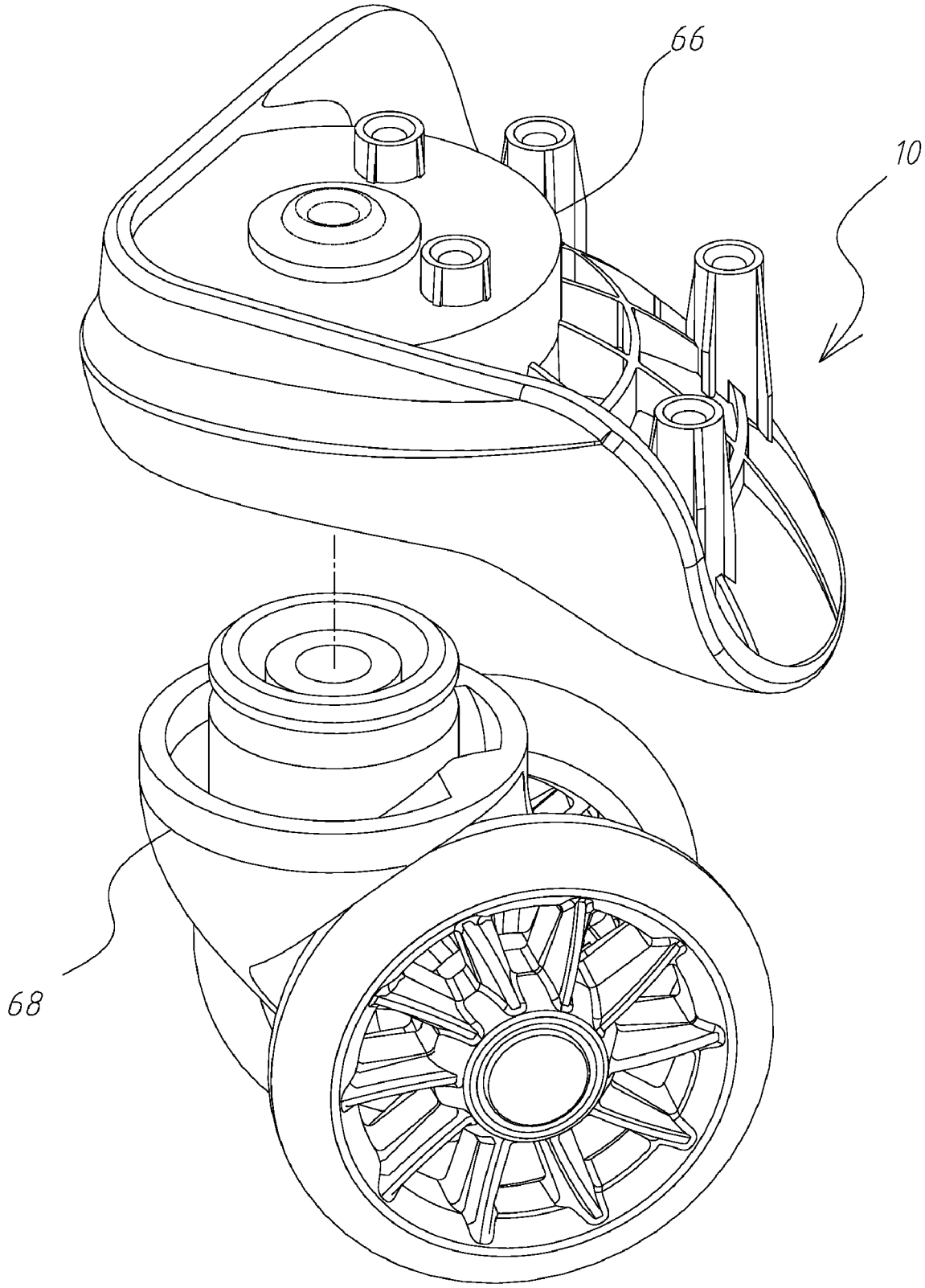
FIG. 1 is a perspective view of a rotatable foot-wheel used for a luggage trunk according to an embodiment of the present invention.
Figure 2:
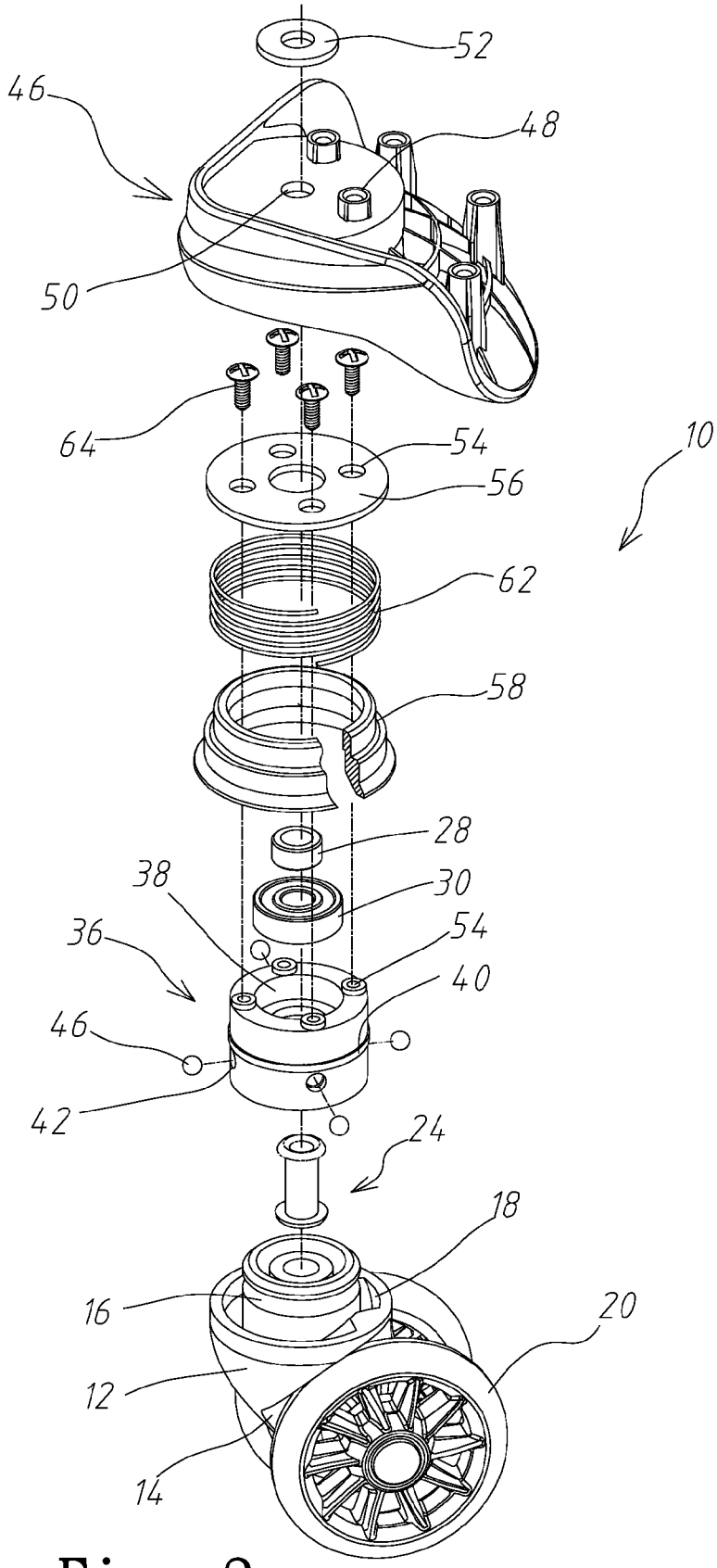
FIG. 2 is an exploded view of a rotatable foot-wheel used for a luggage trunk according to an embodiment of the present invention.
Figure 3:
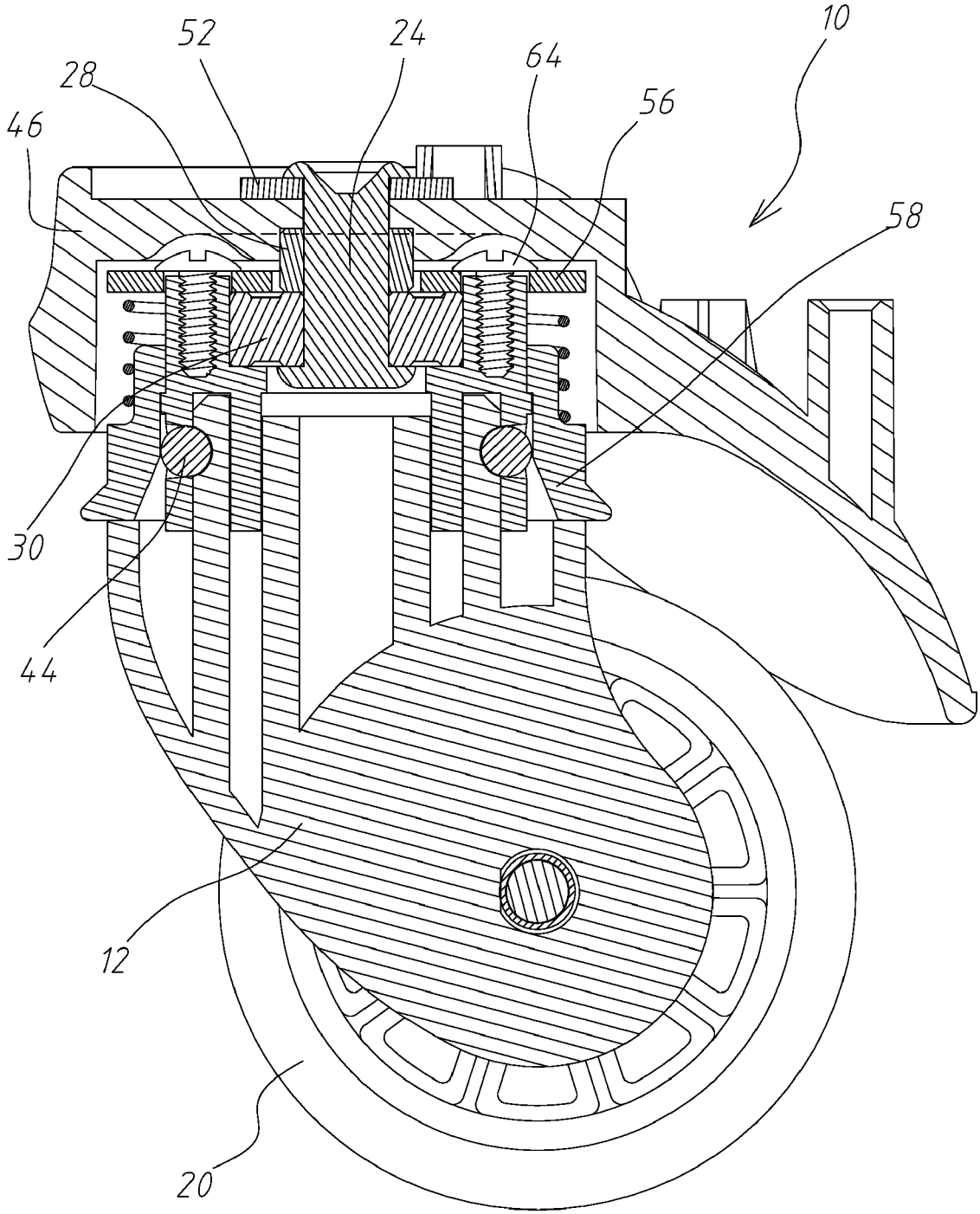
FIG. 3 is a cross section view of rotatable foot-wheel used for a luggage trunk according to an embodiment of the present invention.

The present invention discloses a rotatable foot-wheel having at least a wheel body. In order to fully describe the structure of a rotatable foot-wheel used for a luggage trunk of the present invention, a rotatable foot-wheel having double wheel bodies is taken as an example. Referring to FIGS. 1, 2, and 3 respectively for a perspective view, an exploded view, and a cross-section view of a rotatable foot-wheel used for a luggage trunk according to an embodiment of the present invention. As shown in FIGS. 1, 2, and 3, a rotatable foot-wheel 10 used for a luggage trunk of the present invention includes the following elements:

A wheel stand 12, having a reception portion 14, and a blocking portion 16 is provided in the wheel stand 12 to form integrally together into a body; a first connection portion 18 formed between a wheel stand 12 and a blocking portion 16.

A two-wheel body, each of wheel body 20 is connected with a reception portion 14. Upon the connection of a two-wheel body and a wheel stand 12, and when the two-wheel body is subject to a force, the two-wheel body will rotate freely relative to a wheel stand 12. In other words, when the two-wheel body gets in touch with a horizontal ground and is subject to a force, the two-wheel body will roll along the horizontal ground, hereby making wheel stand 12 produce (together with the two-wheel body) a horizontal displacement.

A rivet 24, which is used to pass through an axle sleeve 28 and a ball bearing 30. A circular rotation block 36, which is provided with a hollow portion 38. The perimeters of the hollow portion 38, the axle sleeve 28, and the ball bearing 30 are connected in a sliding manner, and the perimeter of a circular rotation block 36 is provided with a positioning slot 40.

A ball portion 42, disposed on a ring-shaped outer surface of a circular rotation block 36, and is located below the positioning slot 40. The ball portion 42 is provided with a plurality of balls 44 thereon, and its design is not subject to any restrictions. In the present embodiment, the ball portion 42 is composed of 4 ball slots, and each of the ball slots can be used to receive a ball 44. In another embodiment, the ball portion can be designed into a ball sliding slot, and is full of balls 44 therein. The design of ball portions mentioned above is only used as a preferred embodiment.

A step-shaped housing 58, which can move freely in a first connection portion 18. The step-shaped housing 58 encloses a circular rotation block 36, so that balls 44 may be in rolling contact with an inner surface of the step-shaped housing 58. The inner surface of the step-shaped housing 58 is provided with a spring 62, with its one end fixed into a positioning slot 40, then a tightening plate 56 between a cover body 46 and a step-shaped housing 58 is used to fix the spring 62 between the step-shaped housing 58 and the tightening plate 56. Wherein, on the upper surfaces of a tightening plate 56 and a circular rotation block 36 are each provided with a plurality of mutually corresponding screw holes 54, and a screwing & fixing element 64 is utilized in securing & fixing a fastening plate 56 and a circular rotation block 36. In the present embodiment, the screwing & fixing element 64 is made of a bolt or a screw.

A cover body 64, having its upper surface provided with a third connection portion 48 and a rotation center hole 50. Wherein, the third connection portion 48 is used to be connected to a luggage trunk.

A ring-shaped washer 52, provided on a cover body 46, such that a center of the ring-shaped washer 52 is aligned with the center of a rotation center hole 50.

Upon the engagement of a rivet 24, an axle sleeve 28, and a ball bearing 30, the rivet 24 is used to penetrate through a hollow portion 38, a rotation center hole 50, and an inner ring diameter of a ring-shaped washer. Thus, the ring-shaped washer 52 is utilized to join and connect rivet 24 and cover body 46 together.

Figure 4:
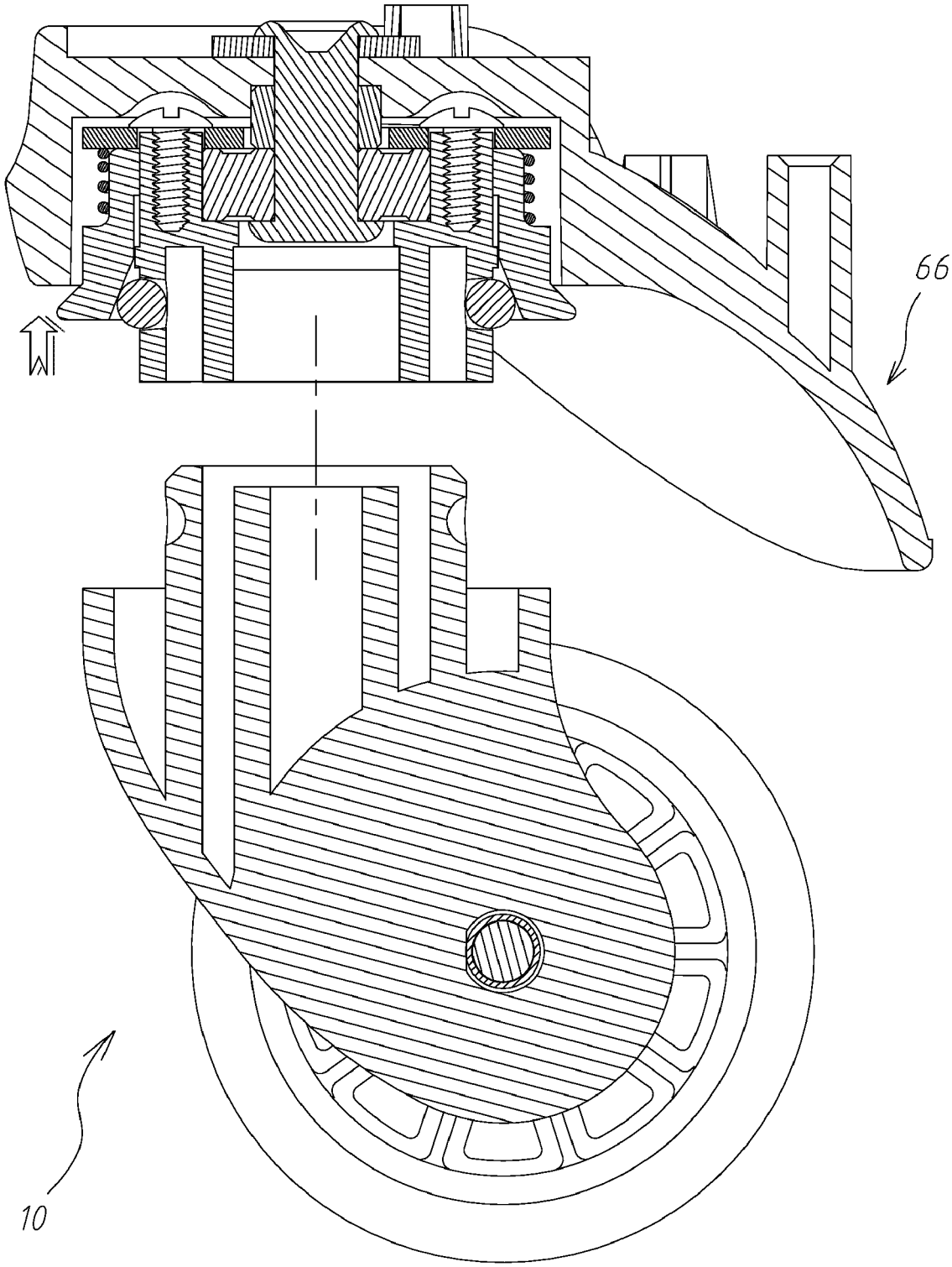
FIG. 4 is a schematic diagram indicating the mounting and detachment of a rotatable foot-wheel used for a luggage trunk according to an embodiment of the present invention.

After long period of usage by a user, the wearing-outs caused by long term frictions between wheel body of a rotatable foot-wheel of a luggage trunk and the ground will result. For this purpose, the present invention discloses a rotatable foot-wheel used in a luggage trunk, and provides user with a simple & convenient mounting & detaching means. As such, based on the above-mentioned structure, such that in detaching a rotatable foot-wheel from a luggage trunk, as shown in FIG. 4, upon securing a lower half portion element 68, all the user has to do is to move the step-shaped housing 58 of an upper half portion element 66 outward, so that balls 44 on a ball portion 42 are separated from a step-shaped housing 58, and then rotating the foot-wheel to make it separate, thus achieving the purpose of detaching a rotating foot-wheel, such that a user may replace worn-out elements by himself. When installing a new element or reinstalling a repaired element, for example, installing a new foot-wheel or reinstalling a repaired foot-wheel to a luggage trunk, in a similar manner, upon securing a lower half portion element 66, all the user has to do is to move the step-shaped housing 58 of an upper half portion element 66 outward, so that balls 44 on the ball portion 42 rejoin with the step-shaped housing 58, hereby achieving the objective of fixing and re-installing elements. Meanwhile, a user may recombine easily a new element (for example, a new lower half portion element) with an upper half portion element of a rotatable foot-wheel, thus obtaining an almost brand new rotatable foot-wheel. Therefore, a user may replace a worn-out element all by himself, and thus a user may re-use a repaired luggage trunk in a speed manner.

Figure 5:
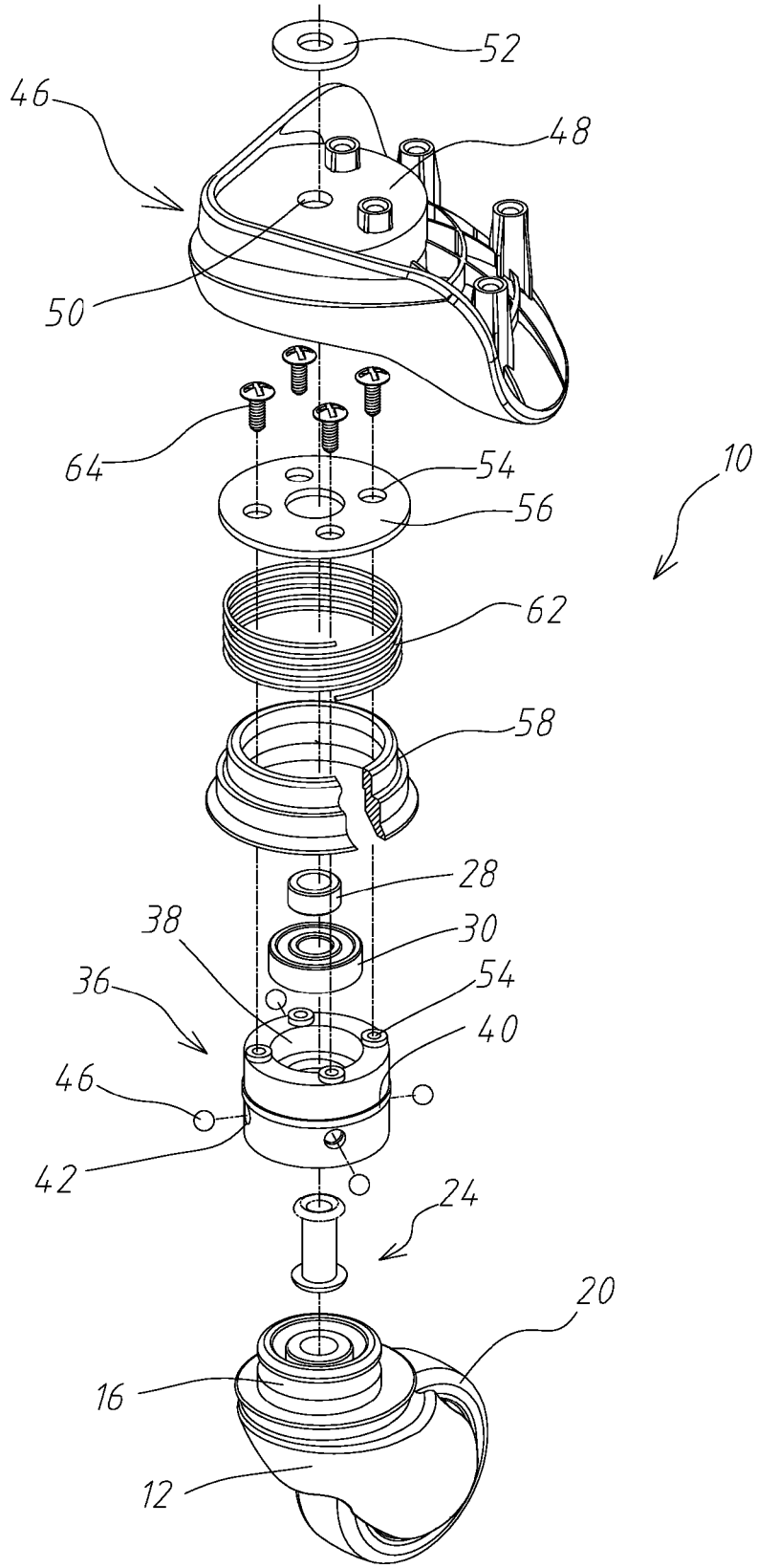
FIG. 5 is an exploded view of a rotatable foot-wheel used for a luggage trunk according to another embodiment of the present invention.

Finally, referring to FIG. 5 for an exploded view of a rotatable foot-wheel used for a luggage trunk according to another embodiment of the present invention. As shown in FIG. 5, the difference between the present embodiment and the previous embodiment lies in the design of a wheel stand 12. In the present invention, a wheel stand 12 is similarly provided with a reception portion 14 and a blocking portion 16. However, the reception portion 14 is different from that of the previous embodiment. In the present embodiment, the reception portion 14 is capable of accommodating only a wheel body 20, and the remaining portions are the same as those of the previous embodiment, and it will not be repeated here for brivity's sake.

The above detailed description of the preferred embodiment is intended to describe more clearly the characteristics and spirit of the present invention. However, the preferred embodiments disclosed above is not intended to be any restrictions to the scope of the present invention. Conversely, its purpose is to include the various changes and equivalent arrangements which are within the scope of the appended claims.

What is claimed is:

1. A rotatable foot-wheel used for a luggage trunk, comprising:

a wheel stand, provided with a reception portion, and in said wheel stand is provided with a blocking portion, and a first connection portion is disposed between said wheel stand and said blocking portion;

at least a wheel body, and is connected to said reception portion, and upon connection of said wheel bodies and said wheel stand and when said wheel bodies are applied a force, said wheel bodies rotates freely relative to said wheel stand;

a rivet, that is used to penetrate through a ball bearing and an axle sleeve;

a circular rotation block, provided with a hollow portion, and said hollow portion is connected to said axle sleeve, said ball bearing in a sliding manner;

a ball portion, provided on a ring-shaped surface of said circular rotation block, and is provided with a plurality of balls;

a step-shaped housing, enclosing said circular rotation block, said balls are in rolling contact with an inner surface of said step-shaped housing, and said step-shaped housing moves freely in said first connection portion;

a cover body, on its upper surface is provided with a third connection portion and a rotation center hole, and third connection portion is used to be connected to said luggage trunk; and a ring-shaped washer, a center of its inner ring diameter is aligned with said rotation center hole, and upon engagement of said rivet, said axle sleeve, and said ball bearing, said rivet is used to penetrate through said hollow portion, said rotation center hole, and said inner ring diameter of said ring-shaped washer, such that said rivet and said cover body are joined together by making use of said ring-shaped washer.

2. The rotatable foot-wheel used for a luggage trunk as claimed in claim 1, further comprising:

a positioning slot located around a perimeter of said circular rotation block, a tightening plate located between said cover body and said step-shaped housing, said step-shaped housing includes a spring, such that said spring is secured between said step-shaped housing and tightening plate by making use of said tightening plate.

3. The rotatable foot-wheel used for a luggage trunk as claimed in claim 2, wherein on upper surfaces of said tightening plate and said circular rotation block are each provided with a plurality of mutually corresponding screw holes, such that said tightening plate and said circular rotation block are secured by making use of a screwing & fixing element.

4. The rotatable foot-wheel used for a luggage trunk as claimed in claim 1, wherein said screwing & fixing element is a bolt or a screw.

* * * * *